US007975704B2

(12) United States Patent
Fiebelkorn

(10) Patent No.: US 7,975,704 B2
(45) Date of Patent: Jul. 12, 2011

(54) SMOKING ARTICLE

(75) Inventor: Richard Thomas Fiebelkorn, Southampton (GB)

(73) Assignee: British American Tobacco (Investments) Limited, London (GB)

( * ) Notice: Subject to any disclaimer, the term of this patent is extended or adjusted under 35 U.S.C. 154(b) by 644 days.

(21) Appl. No.: 11/919,680

(22) PCT Filed: Jul. 19, 2006

(86) PCT No.: PCT/GB2006/002682

§ 371 (c)(1),
(2), (4) Date: Nov. 13, 2007

(87) PCT Pub. No.: WO2007/010249

PCT Pub. Date: Jan. 25, 2007

(65) Prior Publication Data

US 2009/0084392 A1 Apr. 2, 2009

(30) Foreign Application Priority Data

Jul. 21, 2005 (GB) ..... 0514959.6

(51) Int. Cl.
*A24D 3/04* (2006.01)

(52) U.S. Cl. ..... 131/339; 131/274; 131/365; 131/63; 131/336

(58) Field of Classification Search ..... 131/339
See application file for complete search history.

(56) References Cited

U.S. PATENT DOCUMENTS

| | | | | |
|---|---|---|---|---|
| 3,606,892 A | | 9/1971 | Wilson | |
| 3,744,496 A | | 7/1973 | McCarty et al. | |
| 4,225,636 A | * | 9/1980 | Cline et al. | 427/243 |
| 4,505,282 A | * | 3/1985 | Cogbill et al. | 131/334 |
| 4,570,650 A | | 2/1986 | Sirota | |
| 6,606,999 B2 | | 8/2003 | Crooks | |
| 6,854,469 B1 | | 2/2005 | Hancock | |
| 2004/0020504 A1 | | 2/2004 | Snaidr | |

FOREIGN PATENT DOCUMENTS

| | | | |
|---|---|---|---|
| EP | 0539 009 | * | 4/1993 |
| EP | 1421863 | | 2/2003 |
| WO | 2005082180 | | 9/2005 |
| WO | 2007010249 A1 | | 1/2007 |

OTHER PUBLICATIONS

Wang, Jian-min; Relationship between Cigarette Combustibility and Dosage of Burning Accelerant; Tobacco Science; 6th edition; 2000; China.

* cited by examiner

*Primary Examiner* — Richard Crispino
*Assistant Examiner* — Phu H Nguyen
(74) *Attorney, Agent, or Firm* — Charles I. Sherman; Middleton Reutlinger

(57) ABSTRACT

A smoking article in which a patch of web material such as paper containing an adsorbent material therein, such as activated carbon, is positioned towards the mouth end of the smoking article to achieve a flatter puff profile compared to a conventional cigarette by decreasing the smoke constituents in the final few puffs. Characteristics of the smoking articles may be changed to increase the delivery of smoke constituents in the first few puffs in order to maintain a constant ISO NFDPM yield. The adsorbent-containing paper extends over only a portion of the smoking article towards the mouth end and does not comprise a flavorant therein.

27 Claims, 6 Drawing Sheets

SMOKING ARTICLE

CROSS REFERENCE TO PRIOR APPLICATION

This application is a national stage filing (35 U.S.C. 371) of PCT/GB2006/002682, filed on Jul. 19, 2006, which claims priority to and benefit from Great Britain Patent Application No. 0514959.6, filed on Jul. 21, 2005, currently pending.

The invention relates to smoking articles, including but not limited to cigarettes, and in particular to smoking articles having a flatter puff profile than conventional cigarettes, that is, delivering a more consistent level of smoke constituents in each puff during smoking.

It has been known for some time in the tobacco industry that delivery of smoke particulate phase constituents or Total Particulate Matter (TPM) is not uniform during smoking, and that under ISO machine smoking conditions the "strength" per puff, measured in relation to the amount of smoke particulate phase constituents, increases significantly from the first to last puff. This increase in constituents in the later puffs is caused by a number of factors, including a decreased filtration efficiency of the tobacco rod, a decreased level of ventilation of the tobacco rod through the cigarette paper, both of which result from the length of the tobacco rod being reduced during smoking, and an increased smoke particulate phase constituent potential of the tobacco rod resulting from deposition of smoke particulate phase constituents from the earlier puffs onto the tobacco.

The ratio of smoke constituents from first to last puffs in a cigarette varies based on the total smoke constituent yield for that product and other product construction characteristics. Typically a ratio value of between 2 and 4 for full flavour products (>10 mg TPM), between 3 and 5 for "lights" (5-10 mg TPM) and between 4 and 6 for "ultra lights" (<5 mg TPM) is achieved under ISO machine smoking conditions. The increase in the ratio as smoke constituent yields decrease largely results from the higher levels of ventilation used in such products. This imbalance in the yield of smoke constituents between the first and last puffs can lead to consumer rejection of the product as a result of a perception of being too "weak" in the first few puffs or too "strong" in the final few puffs. This problem is greater for the products yielding a lower level of smoke constituents due to the much larger differences in smoke constituents measured between the first and last puffs. There is accordingly a desire to provide a cigarette with a flatter puff profile that is able to deliver a similar level of smoke constituents in both the first and last puffs.

Furthermore it is known that the increased level of smoke constituents delivered in the final few puffs represents a significant proportion of the total amount of smoke constituents generated in all cigarette products. Accordingly, by reducing the delivery of smoke constituents in the final few puffs the total amount of smoke constituents delivered will be reduced.

A previous attempt to reduce constituent delivery and provide a more uniform constituent delivery is described in U.S. Pat. No. 3,902,504, which discloses a cigarette having shredded carbon paper incorporated within the tobacco rod in increasing amounts towards the mouth end of the cigarette. This is achieved in two ways, the first of which involves producing a number of discrete segments each having a different amount of shredded carbon paper blended with tobacco and arranging the segments into a column so that the segment containing the highest level of carbon paper is closest to the mouth end of the cigarette, and the segments towards the lighting end of the cigarette contain progressively less carbon paper. The second embodiment has a tobacco rod in which tobacco is blended with shredded carbon paper in increasing amounts towards the mouth end of the cigarette, without the need to produce segments. The increased levels of shredded carbon paper at the mouth end of the cigarette result in a more consistent yield of tar and nicotine compared to conventional cigarettes upon smoking. However, there are significant difficulties involved in producing a cigarette according to U.S. Pat. No. 3,902,504, in both of the described embodiments. In the first, it is necessary to produce a number of segments each having a blend of tobacco and shredded carbon paper in differing quantities and then arranging the segments to form a rod, ensuring that the segment with the highest level of shredded carbon paper is at the mouth end of the cigarette, and that further segments are correctly ordered according to the amount of shredded carbon paper contained therein. This is a highly involved process for the manufacture of a single cigarette, both in terms of blending each segment and in arranging the segments in the correct order, and is not possible at the high speeds usually used in cigarette manufacture. A further disadvantage associated with the segmented cigarette is that during smoking the final portion of each segment is liable to fall from the cigarette as a hot coal due to the lack of integrity of one segment to an adjacent segment. Such a hot coal fall out from the cigarette end is likely to result in such a product being rejected by the consumer. In the second embodiment it is necessary to produce a tobacco rod in which the tobacco and shredded carbon paper is blended so that progressively increasing amounts of carbon paper are present at the mouth end of the rod. This involves a complex method in which the amount of shredded carbon paper supplied to the rod at the mouth end is increased whilst reducing the amount of tobacco supplied to ensure that the total amount of material, in particular the shredded carbon paper, within the rod is consistent. Again, such intricate construction of the product is not possible at the high speeds usually used in cigarette manufacture.

The use of a carbon filled wrapper in a cigarette for reducing the Total Particulate Matter of mainstream smoke is known from U.S. Pat. No. 3,744,496. Described is a cigarette having a tobacco column circumscribed by a carbon filled paper as an inner wrapper with a conventional cigarette paper forming an outer wrapper. It was found that the cigarette significantly reduces the Total Particulate Matter yield and the organic vapour phase constituents of mainstream smoke, as well as reducing visible sidestream smoke. However, the cigarette disclosed in U.S. Pat. No. 3,744,496 is concerned only with reducing the total smoke components of the cigarette throughout consumption and does not attempt to alter the profile of constituents delivered during smoking. Furthermore, the cigarette will suffer from the disadvantages associated with a full length double wrapped cigarette, including undesirable taste characteristics and high levels of mainstream carbon monoxide.

The provision of a patch of carbon paper positioned towards the mouth end, or alternatively towards the lighting end, of a cigarette on the inside of a conventional cigarette wrapper is disclosed in our co-pending international patent application number PCT/GB/2005/000669. This describes a cigarette in which a patch of carbon paper, or other adsorbent-containing paper, containing a flavourant is applied to a cigarette wrapper before being wrapped about a rod of tobacco on a cigarette making machine such that the flavoured carbon paper patch is positioned at or towards the mouth, or filter, end of the tobacco rod. This allows the flavoured carbon paper patch to be applied in an on-line process at high speeds suitable for commercial production. The resulting cigarette provides a "fresh finish" to the consumer during the final few puffs as the flavourant that is stably held in the carbon of the carbon paper is volatilised by the heat from the advancing burning coal. However, the cigarette of PCT/GB/2005/000669 is concerned with providing a stabilised flavourant at a precise position in a cigarette and does not contemplate the use of a carbon paper patch without flavourant therein.

It is an object of the present invention to provide a smoking article having a reduced yield of smoke constituents, including particulate phase and/or vapour phase constituents compared to a conventional cigarette, in the final portion of the cigarette for delivery to the consumer during smoking.

It is a further object of the invention to provide a smoking article having a precisely positioned adsorbent therein.

It is yet further object of the present invention to provide a smoking article having a flatter puff profile in relation to smoke particulate phase constituents delivered per puff compared to a conventional cigarette.

It is an even further object of the present invention to provide a smoking article having an increased strength sensation in the first few puffs and/or a decreased strength sensation in the final few puffs during smoking.

The present invention provides a smoking article comprising a rod of smokable material, a wrapper circumscribing said rod of smokable material and a patch of web material, said patch of web material comprising an adsorbent material and being positioned towards a mouth end of the smoking article and extending over only a portion of the length of the rod of smokable material, wherein said patch of web material does not comprise a flavourant therein.

Preferably the patch of web material is positioned between said rod of smokable material and said wrapper. Advantageously the web material is adhered to a surface of the wrapper, which surface is a surface facing the rod of smokable material, that is, an interior face of the wrapper. The web material is suitably adhered to the wrapper by an adhesive. It is preferred that the adhesive is one of the following: a heat-activatable adhesive, PVA, starch, and starch solution.

The wrapper of the smoking article is suitably a conventional cigarette paper well known in the art. The smoking article may be wrapped in more than one wrapper, and may be, for example, double wrapped. It is preferred however that the smoking article is wrapped in a single wrapper.

It is by preference that the smoking article comprises a filter element. The filter element may suitably be of conventional fibrous cellulose acetate, polypropylene or polyethylene material or gathered paper material. The filter element may be a multiple filter comprising multiple sections such as, for example, a dual or triple filter. Suitable filters are well known to those skilled in the art. A suitable filter element may contain an adsorbent material for the reduction of vapour phase constituents of smoke. Such filters known in the art include Dalmatian filters in which particulate activated carbon is interspersed in the cellulose acetate material of the filter and cavity filters in which a cavity portion of a multi-segment filter is filled with activated carbon granules. In addition, the pressure drop and/or mechanical filtration efficiency of the filter element can be selected to achieve the desired smoking mechanics and filtration characteristics as may be required for a desired product.

Suitably the filter of the present invention is wrapped in a plug wrap and attached to the rod of smokable material by means of a tipping wrapper. It is much by preference that the tipping wrapper is ventilated by means of ventilation holes therein. The ventilation means may suitably comprise perforation holes in the tipping wrapper used to interattach the filter element and the wrapped rod of smokable material, together with corresponding perforation holes in the plugwrap. Alternatively the ventilation means may be provided by the use of a porous tipping wrapper used in conjunction with a perforated plugwrap. The porous tipping wrapper may be porous over its full extent or over only a localised extent, which extent is in registration with the underlying perforated plugwrap. It is preferred that ventilation is at a level greater than 10%, and advantageously at a level greater than 50%. It is advantageous that the ventilation means is positioned at a distance 11-17 mm from the mouth end of the smoking article.

Preferably the web material is a fibrous sheet material and more preferably a cellulosic sheet material or a tobacco-containing sheet material. The fibrous sheet material is advantageously a cellulosic web material and most advantageously is a paper web material. The paper web material may be flat, creped or calendared. Advantageously the adsorbent material is incorporated within the web material, the adsorbent being an integral component of the web material.

Suitably the adsorbent material is one or more of the following: zeolite, sepiolite, clay, activated alumina, mineral, resin, carbon. Preferably the adsorbent material is carbon and more preferably is activated carbon.

Advantageously the adsorbent material is in granular, powder or particulate form. Where the adsorbent material is in granular, powder or particulate form, the adsorbent material preferably has particle sizes of less than 500 μm and preferably less than 100 μm. More preferably the adsorbent material has particle sizes of less than 50 μm and most preferably has a mean particle size of less than 20 μm. The particle size is considered to be the diameter of the particle.

Suitably the level of loading of the adsorbent material in the web material is less than 70% by weight of the web material. For example the level of loading of the adsorbent material in the web material may be less than 50% by weight of the web material. Advantageously the adsorbent material loading in the web material is 10-45% by weight, for example from 30-45% by weight, of the web material.

When the adsorbent material is activated carbon it is preferred that the carbon has a level of activity up to 180% CTC. More preferably the carbon has an activity of 40-160% CTC. Activity of carbon is measured in percent carbon tetrachloride (CTC), a measurement well known in the art. Carbon is weighed, exposed to CTC and the weight of the carbon subsequently re-measured. The increase in weight of the carbon is calculated as a percentage.

Further materials may be added to the web material of the invention. Such materials include inorganic fillers and additives. For example, a preferred filler material is calcium carbonate. Other inorganic fillers known in the art include titanium oxide, magnesium oxide, calcium sulphate, clays and kaolins.

Suitably the level of loading of the inorganic filler in the web material is less than 70% by weight of the web material. For example, the level of loading of the inorganic filler in the web material may be less than 50% by weight of the web material. Advantageously the inorganic filler loading in the web material is 10-30% by weight of the web material.

The patch of web material has a base weight in the range 30-200 grams per square meter (gsm), and preferably in the range 55-100 gsm. Suitably the web material has a porosity of less than 3000 CU. The web material suitably has a thickness of 50-500 μm and preferably has a thickness of 150-300 μm.

The patch of web material comprising an adsorbent therein preferably comprises an additive to control the burn rate (hereinafter referred to as a "burn rate additive"). The inclusion of an additional web material containing carbon slows the burn rate (inter puff burn rate) of the cigarette during the final puffs, potentially resulting in an increased puff number and thus an increase in particulate smoke constituents delivered to the consumer. Inclusion of a burn rate additive results in an increased burn rate of the patch and greatly improves ash formation. Preferably the burn rate additive is a citrate, such as sodium or potassium citrate. Other suitable burn rate additives, such as sodium or potassium salts, such as acetate and tartrate, mono-ammonium phosphate, and di-sodium hydrogen phosphate, for example, will be known to the skilled man. Advantageously the burn additive is present in the range up to 5% by weight of the web material, and preferably in an amount up to 2% by weight. In one embodiment the burn additive is present in an amount of 0.1 to 2%.

Preferably the smokable material is a tobacco material. Suitably the tobacco material comprises one or more of stem, lamina, and tobacco dust. It is preferred that the tobacco material comprises one or more of the following types: Virginia or flue-cured tobacco, Burley tobacco, Oriental tobacco, reconstituted tobacco, and expanded tobacco. It is much by preference that the smokable material comprises a blend of tobacco material, and may for example comprise 10-80% Virginia tobacco, 10-60% Burley tobacco, 0-20% Oriental tobacco, 0-30% reconstituted tobacco, 0-50% expanded tobacco and 0-30% stem.

The smokable material may alternatively or in addition comprise a tobacco substitute material.

It is preferred that the rod of smokable material, in the region over which the patch of web material extends, comprises a lower weight of smokable material per unit length of the rod of smokable material. This reduction in weight per unit length of smokable material is in comparison to the portion of the rod of smokable material over which the patch of web material does not extend. Such a reduction in weight per unit length of smokable material also results in a lower volume of smokable material per unit length of the rod of smokable material. This reduction in weight ensures that the reduction in internal volume of the rod of smokable material caused by the patch of web material does not result in an increased density of smokable material in the region of the rod of smokable material over which the patch of web material extends. Accordingly, no increased filtration efficiency results from the rod of smokable material that would potentially affect the perceived strength of the smoking article and increase filtration of smoke constituents in the first few puffs. In one embodiment the lowering of the weight of the smokable material in the region over which the patch of web material extends is such that the density of smokable material in such region is lower than the density of the smokable material in the region over which the patch of web material does not extend, for example, up to 25% lower. In one embodiment the density of the smokable material in the region over which the patch of web material extends is 1-20%, such as 1-15%, for example 1-10%, lower than the density of the smokable material in the region over which the patch of web material does not extend. It is preferred that the lower weight per unit length of smokable material is such that the density of smokable material along the rod of smokable material remains constant. The amount of weight reduction to be utilised to achieve a desired density in the region over which the patch of web material extends will, for example, depend on the thickness and size of the patch of web material.

The smokable material may also comprise a flavourant, casing, and/or burn additive to enhance the smoking properties thereof. Depending on the properties of the filler the burn additive is either a burn promoter or a burn retardant. Suitable burn additives may be selected from one or more of salts of Group I or II metals such as acetates, citrates and other burn promoters known to the skilled man. Suitable burn retardants include magnesium hydroxide, mono-ammonium phosphate or magnesium chloride, for example.

The smokable filler material may also comprise an ash improver, which is advantageously present in the filler in the range of 0-5%. Appropriate ash improvers include one or more of mica, perlite, chalk, clays, such as, for example, vermiculite, kaolinites, talcs, saponites, bentonites, as well as ash improvers such as disodium hydrogen orthophosphate, sodium carbonate, calcium carbonate or diammonium phosphate, for example.

It is preferred that the web material substantially fully circumscribes the rod of smokable material. Preferably the web material extends 10-80%, and more preferably 30-80%, of the length of the rod of smokable material. In a first aspect the web material extends from a point at, i.e. immediately adjacent, the mouth end of the rod of smokable material to a point towards the lighting end of the smoking article. Advantageously the point towards the lighting end is a point 10-80%, and preferably 30-80%, of the distance along the rod of smokable material from the mouth end of the smoking article. In a second aspect the web material extends from a first point towards, but spaced from, the mouth end of the rod of smokable material to a second point towards the lighting end of the smoking article. Preferably the first point towards the mouth end of the smoking article is a point at least 10% of the distance along the rod of smokable material from the mouth end of the smoking article. Further it is preferred that the second point towards the lighting end of the smoking article is a point 11-80%, and even more preferably 30-80%, of the distance along the rod of smokable material from the mouth end of the smoking article.

Two or more patches of web material may extend along the length of the rod of smokable material. In one aspect of the invention the smoking article comprises first and second patches of web material such that the second patch extends over a smaller portion of the length of the rod of smokable material than the first patch. It is preferred that the first and second patches are immediately adjacent one another, and more preferably the first patch is adjacent the wrapper and the second patch is adjacent the rod of smokable material. It is understood that the second patch of web material comprises an adsorbent material therein but does not comprise a flavourant, as specified in terms of the first patch of web material in accordance with the invention.

The apparatus and method used for producing the smoking articles of the present invention, and in particular the application of the patch of adsorbent-containing web material within the smoking article, is as described in our co-pending international patent application number PCT/GB/2005/000669, the contents of which are hereby incorporated herein by reference.

As used herein the term "smokable material" is merely intended to mean that part of the smoking article which is contained within the wrapper and should not have imported therein any association as to the combustibility or otherwise of individual components of the rod of the smokable material.

As used herein the term "patch" is merely intended to mean a portion of web material and does not denote any size dimensions or other characteristics, except as explicitly described herein in relation to the patch.

In one embodiment the patch of web material comprises inorganic filler and burn additive in addition to the adsorbent material. In this embodiment the patch of web material suitably comprises the adsorbent material in an amount of less than 70%, for example less than 50%, by weight of the web material. Advantageously the adsorbent material is present in the web material in an amount of from 10-45% by weight, for example from 30-45%, by weight of the web material. Also in this embodiment the patch of web material suitably comprises the inorganic filler in an amount of less than 70%, for example less than 50%, by weight of the web material. Advantageously the inorganic filler is present in the web material in an amount of from 10-30% by weight of the web material. Further, in this embodiment the patch of web material suitably comprises the burn additive in an amount of up to 5%, preferably in an amount of up to 2%, for example in an amount of 0.1-2%, by weight of the web material. Preferably, in this embodiment, the adsorbent material is carbon, the inorganic filler is calcium carbonate, and the burn additive is a citrate such as potassium citrate. The ratio of calcium carbonate:carbon may be about 1:1 to about 1:2, for example about 1:1.5. For example, the patch of web material may comprise about 35% by weight of carbon, about 25% by weight of calcium carbonate, and about 0.5% by weight of citrate such as potassium citrate.

An advantage of the above-described embodiment wherein the patch of web material comprises adsorbent material such as carbon, inorganic filler such as calcium carbonate, and burn additive such as a citrate, is that, by controlling the form of the adsorbent material (e.g. granule form, particle form or powder form) and the type and amount of inorganic filler and burn additive, ash formation and burn rate during smoking of the smoking article can be satisfactorily controlled.

In order that the subject invention may be easily understood and readily carried into effect, reference will now be made, by way of example, to the accompanying diagrammatic drawings, in which.

Figure 8:
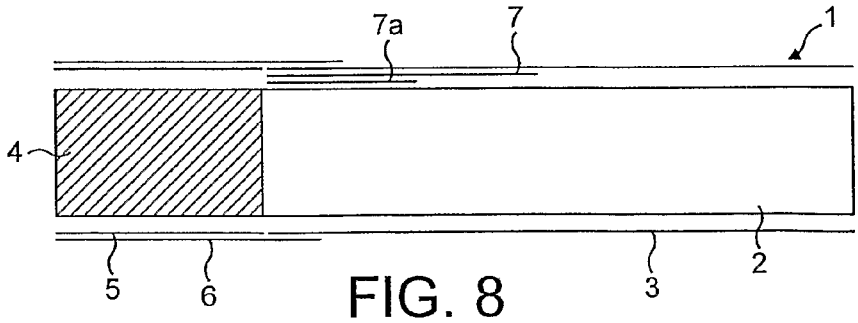
Figure 9:
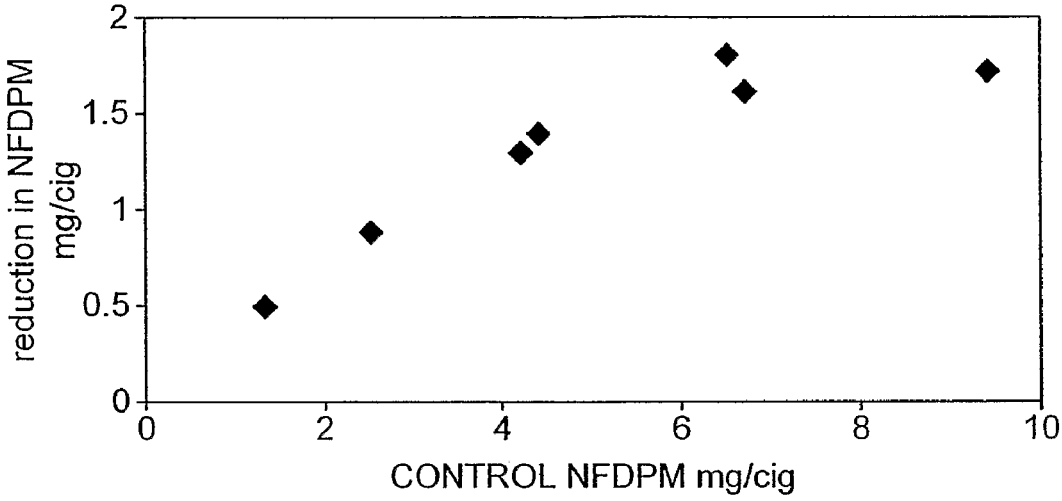
Figure 10:
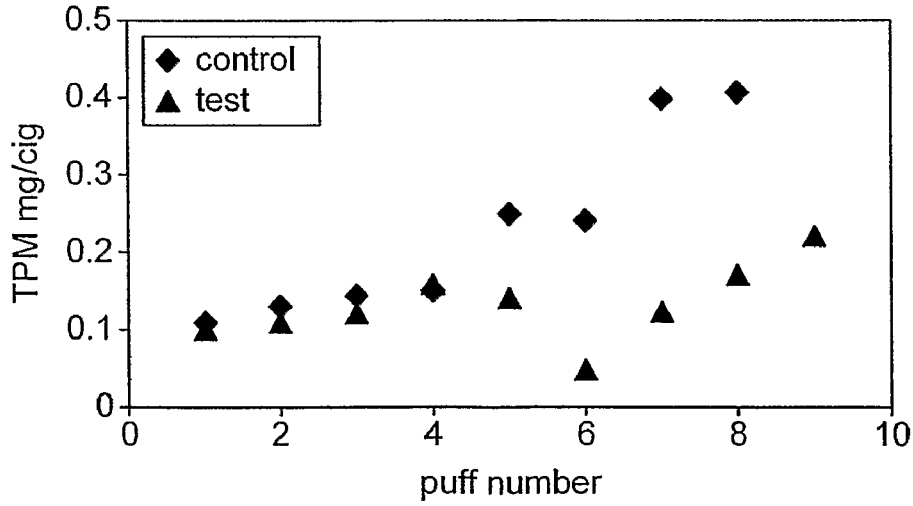
Figure 11:
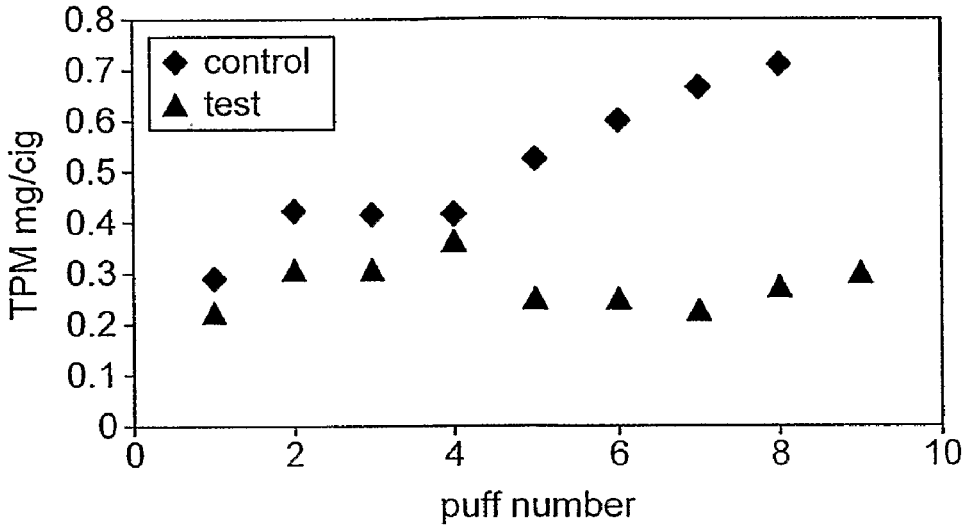
Figure 12:
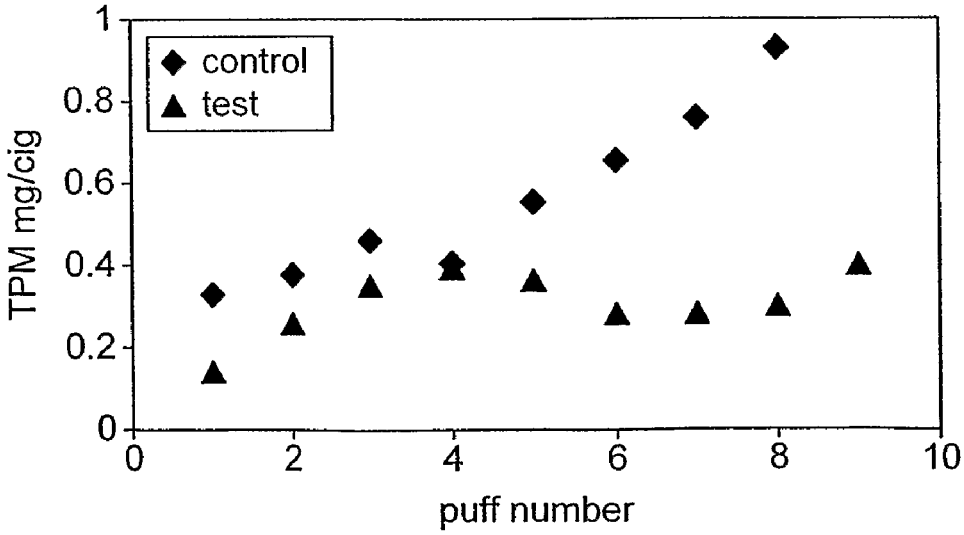
Figure 13:
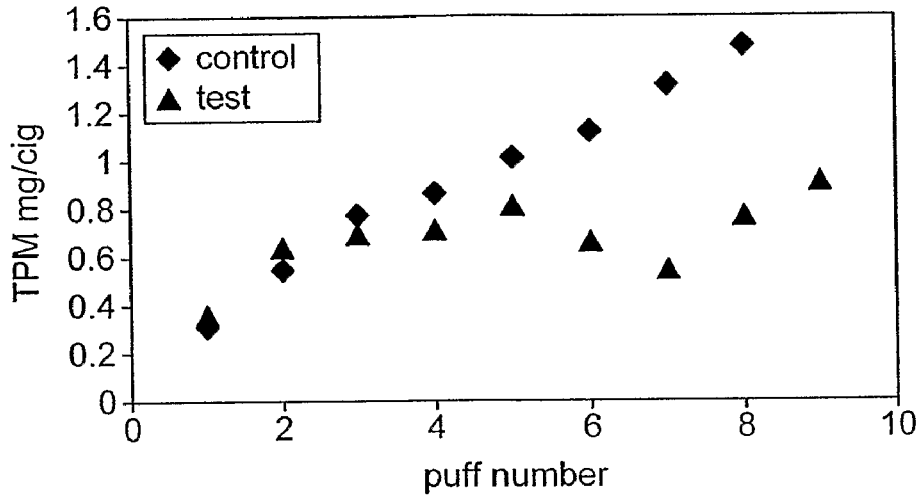
Figure 14:
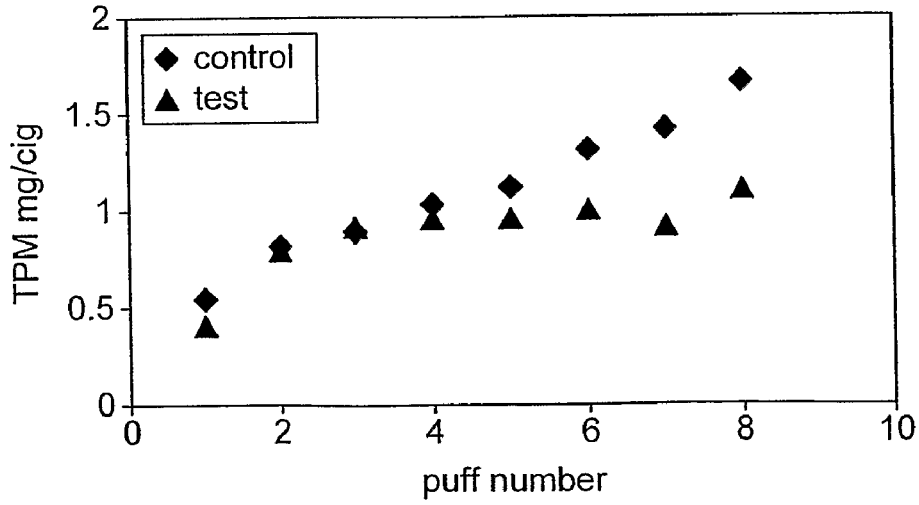
Figure 15:
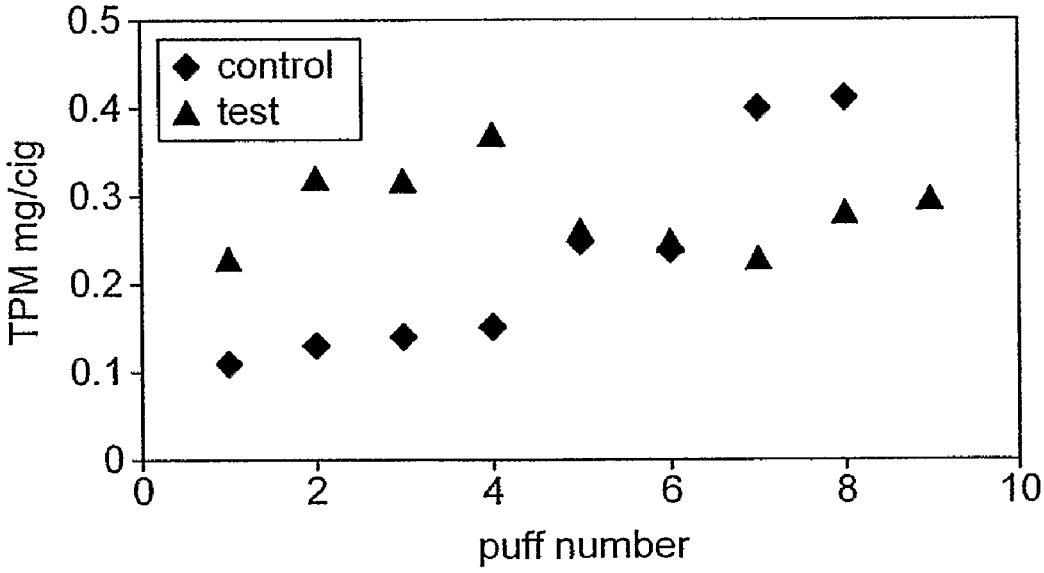

FIG. 8 diagrammatically shows a cross-section longitudinally through a smoking article according to a yet further embodiment of the invention;

FIG. 9 is a graph showing the total reduction of NFDPM in cigarettes according to the invention against NFDPM of comparable control cigarettes;

FIG. 10 shows a graph of TPM against puff number for a cigarette according to the invention compared to a control cigarette;

FIG. 11 shows a graph of TPM against puff number for a further cigarette according to the invention compared to a control cigarette;

FIG. 12 shows a graph of TPM against puff number for a further cigarette according to the invention compared to a control cigarette;

FIG. 13 shows a graph of TPM against puff number for a further cigarette according to the invention compared to a control cigarette;

FIG. 14 shows a graph of TPM against puff number for a yet further cigarette according to the invention compared to a control cigarette; and FIG. 15 shows a graph of TPM against puff number for a further cigarette according to the invention compared to a conventional cigarette.

Figure 1:
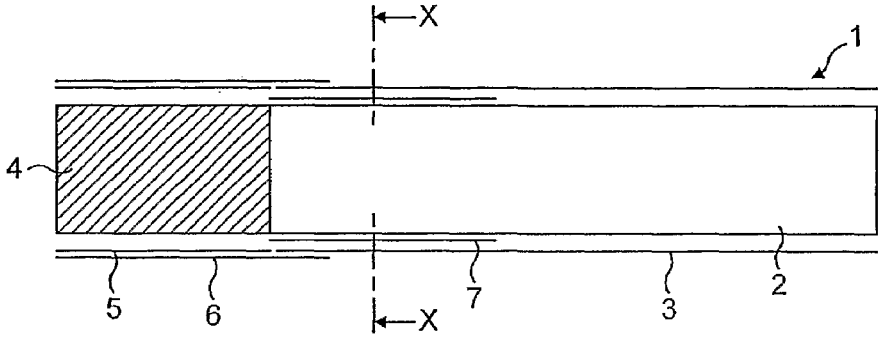
FIG. 1 shows a cross-section longitudinally through a smoking article according to the invention.

FIG. 1 shows a smoking article (1) according to the invention in longitudinal cross-section. The smoking article (1) comprises a rod of smokable material (2) circumscribed by a cigarette wrapper (3). A filter (4) is positioned at the mouth end of the smoking article (1). The filter (4) is circumscribed by a plugwrap (5) and is attached to the rod of smokable material (2) by a tipping paper (6) as is usual in the art. The smoking article (1) has a patch of carbon paper (7) located at the mouth end of the rod of smokable material (2). The patch of carbon paper (7) circumscribes the entire circumference of the smoking article (1). The cigarette wrapper (3) surrounds the rod of smokable material (2) and the carbon paper (7). The patch of carbon paper (7) is immediately adjacent the filter (4) in the smoking article (1).

Upon smoking, the smoking article (1) is lit at one end, such end being the end furthest from the patch of carbon paper (7), and hence furthest from the filter (4), and smoke is drawn along the rod of smokable material (2) to the consumer. In the initial few puffs the smokable material (2) being combusted is not surrounded by the patch of carbon paper (7) and thus there is little reduction of smoke constituents by the carbon paper. As the smoking article (1) is further smoked and the burning coal advances along the rod of smokable material (2) towards the mouth end of the smoking article (1) the carbon paper (7) adsorbs material generated from the coal and hence reduces the smoke constituents in the final puffs to create a reduced strength sensation and a flatter puff profile for the cigarette during smoking.

Figure 2:
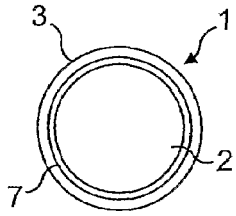
FIG. 2 shows a cross-section through the smoking article of FIG. 1 along line x-x.

FIG. 2 shows a transverse cross-section through the smoking article (1) of FIG. 1 along line x-x showing the wrapper (3) circumscribing the rod of smokable material (2) and the patch of carbon paper (7) extending around the entire circumference of the rod of smokable material (2) to the interior of the wrapper (3).

Figure 3:
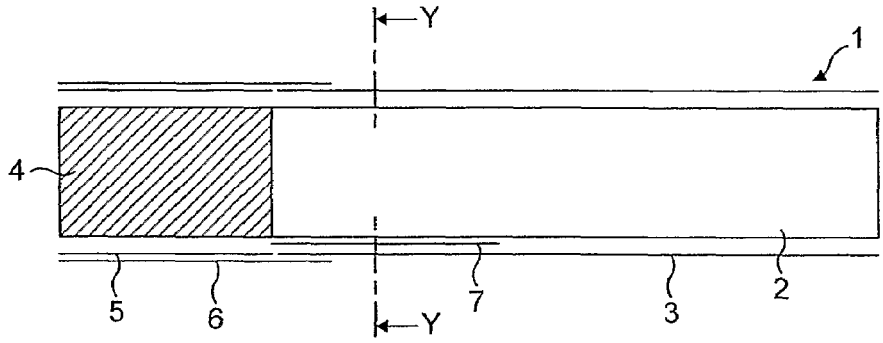
FIG. 3 shows a cross-section longitudinally through a smoking article according to a further embodiment of the invention.

FIG. 3 shows a smoking article (1) in longitudinal cross-section similar to that of FIG. 1, with the exception that the patch of carbon paper (7) extends over only a part of the circumference of the smoking article (1). For simplicity, like reference numerals are used to denote similar features throughout the Figures.

Figure 4:
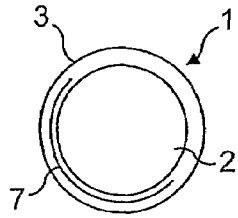
FIG. 4 shows a cross-section through the smoking article of FIG. 3 along line y-y.

FIG. 4 shows a transverse cross-section through the smoking article (1) of FIG. 3 along line y-y, showing the wrapper (3) circumscribing the rod of smokable material (2) and the patch of carbon paper (7) extending only partially around the circumference of the rod of smokable material (2) on the inner face of the wrapper (3).

Figure 5:
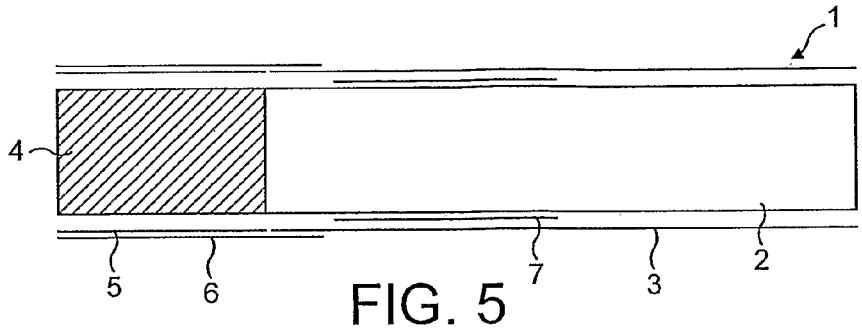
FIG. 5 shows a cross-section longitudinally through a smoking article according to a further embodiment of the invention.

FIG. 5 shows in cross-section a smoking article (1) similar to that of FIGS. 1 and 3, in which the patch of carbon paper (7) is positioned at a distance spaced from the end of the smoking article (1) corresponding to the mouth end thereof, such that the patch of carbon paper (7) is near to, but not at, the end of the rod of smokable material (2), and does not immediately abut the filter (4).

Figure 6:
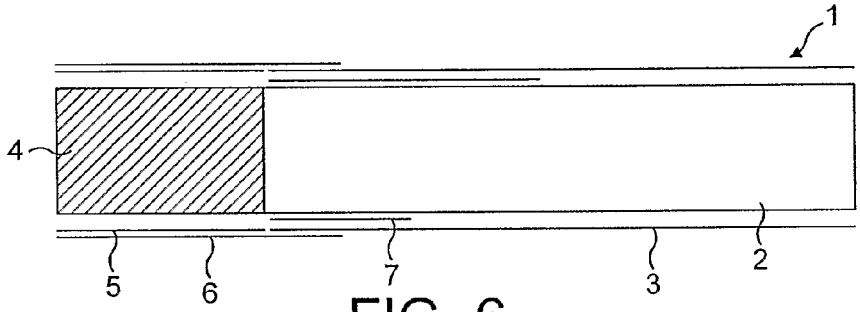
FIG. 6 shows a cross-section longitudinally through a smoking article according to a further embodiment of the invention.

FIG. 6 shows in cross-section a smoking article (1) similar to that of FIGS. 1-3, in which the patch of carbon paper (7) is tapered in shape and thus extends along the smoking article (1) to differing amounts around the circumference of the rod of smokable material (2). In this embodiment the patch of carbon paper (7) is substantially triangular in shape.

Figure 7:
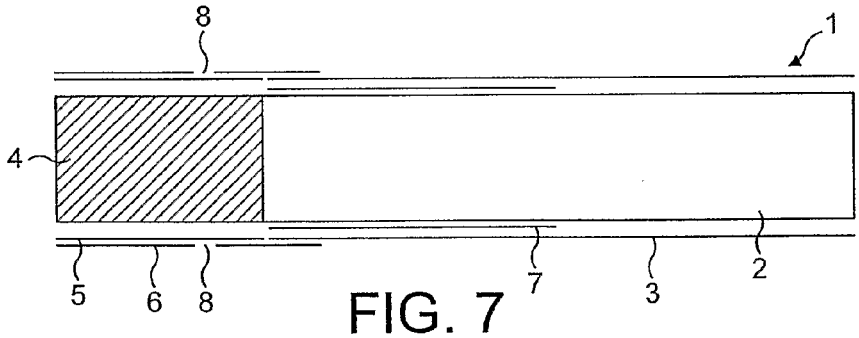
FIG. 7 shows a cross-section longitudinally through a smoking article according to a yet further embodiment of the invention.

FIG. 7 shows the smoking article (1) of FIG. 1 in longitudinal cross-section with the addition of ventilation holes (8)

extending through the tipping paper (6) around the circumference of the filter (4). The ventilation holes (8) are formed by laser perforation during the production of the smoking article (1) and are positioned approximately 15 mm from the mouth end of the smoking article (1).

FIG. 8 shows in cross-section a smoking article (1) similar to that of FIGS. 1-3, in which a first patch of carbon paper (7) extends approximately halfway along the length of the rod of smokable material (2) on the inside of a wrapper (3). A second patch of carbon paper (7*a*) extends approximately one quarter of the length of the rod of smokable material (2) of the smoking article (1). This second patch of carbon paper (7*a*) extends between the first patch of carbon paper (7) and the rod of smokable material (2).

EXAMPLE 1

Sample cigarettes were made having a standard king-size format, namely 84 mm length and 24.6 mm circumference, with a cellulose acetate filter element 27 mm in length, a 32 mm overtipping and having on-line laser tip ventilation. Further details of each sample, relating to blend, tobacco density, paper, filter pressure drop and tip ventilation, are given in Table 1.

Test cigarettes were constructed with the same characteristics as the sample cigarettes with the addition of an activated carbon patch on the inside of the wrapper at the filter end of the cigarette. Each activated carbon patch had a length of 30 mm and a width of 23 mm and had a composition as follows: base weight of 58.3 gsm (fibre 35 gsm and carbon 23.3 gsm, giving a carbon loading of approximately 40%); porosity of 2000 CU; tensile strength of 36N/50 mm; elongation of 4.6%; thickness of 280 μm; carbon activity of 100 CTC.

The cigarettes were machine smoked under ISO accredited standard conditions (35 cc puff volume; 2 second puff duration; 58 second inter puff duration) and the total Nicotine-Free Dry Particulate Matter (NFDPM) results for the test cigarettes compared to the control cigarettes are set out in Table 2. The samples have differing tar yields and encompass a range of tar yields common in known cigarettes. Also shown in the final column of Table 2 is the reduction in NFDPM (mg/cig) for each of the test cigarettes in comparison to the respective control sample.

TABLE 1

| Sample | Blend | Tobacco Density (mg/cc) | Cigarette Paper Permeability (CU) | Filter Pressure Drop (mm/WG) | Tip Ventilation (%) |
|---|---|---|---|---|---|
| 1 | Modified Flue-cured | 210 | 50 | 100 | 82 |
| 2 | Modified Flue-cured | 210 | 50 | 90 | 75 |
| 3 | American | 242 | 50 | 90 | 60 |
| 4 | American | 242 | 50 | 110 | 55 |
| 5 | American | 242 | 50 | 60 | 55 |

TABLE 1-continued

| Sample | Blend | Tobacco Density (mg/cc) | Cigarette Paper Permeability (CU) | Filter Pressure Drop (mm/WG) | Tip Ventilation (%) |
|---|---|---|---|---|---|
| 6 | American | 242 | 50 | 75 | 45 |
| 7 | American | 242 | 50 | 60 | 40 |

TABLE 2

| | NFDPM (mg/cig) | | |
|---|---|---|---|
| Sample | Control | Test | Reduction |
| 1 | 1.3 | 0.8 | 0.5 |
| 2 | 2.5 | 1.6 | 0.9 |
| 3 | 4.2 | 2.9 | 1.3 |
| 4 | 4.4 | 3.0 | 1.4 |
| 5 | 6.5 | 4.7 | 1.8 |
| 6 | 6.7 | 5.1 | 1.6 |
| 7 | 9.4 | 7.7 | 1.7 |

It can be seen from Table 2 that each of the test samples resulted in a total NFDPM significantly less than that of each of the comparable control cigarettes. The reduction in NFDPM in mg/cig for each test cigarette is plotted against the amount of NFDPM of the controls in FIG. 9.

EXAMPLE 2

Several of the samples described in Example 1 above, namely Samples 1, 2, 3 5 and 7, were evaluated for Total Particulate Matter (TPM) on a puff-by-puff basis. Each sample was smoked to a 35 cc puff volume, 2 second duration and a 58 second inter-puff duration, to the nearest whole puff number and the TPM for each puff recorded. Table 3 shows the TPM for each puff, together with the total TPM, for each test cigarette in comparison to the comparable control sample. The TPM per puff results for Samples 1, 2, 3, 5 and 7 are shown graphically in FIGS. 10, 11, 12, 13 and 14 respectively. It is clear from Table 3 and FIGS. 10-14 that the test cigarettes have a significantly reduced TPM in the final few puffs, and in particular in puffs 5 to 9. These results show that cigarettes having a carbon patch circumscribing a tobacco rod at the filter end of a cigarette can substantially reduce TPM in the final puffs and reduce the associated strength perception in these puffs.

EXAMPLE 3

Sample 2 as described in Example 1 above was designed with a lowered pressure drop of the filter and a lowered level of tip ventilation compared to Sample 1, such that the ISO NFDPM yields from the Sample 1 control and Sample 2 test cigarettes would be similar.

The specific details of these cigarettes are shown in Table 4. These cigarettes were

TABLE 3

| | TPM per puff (mg/puff) | | | | | | | | | |
|---|---|---|---|---|---|---|---|---|---|---|
| Puff | Sample 1 | | Sample 2 | | Sample 3 | | Sample 5 | | Sample 7 | |
| Number | Control | Test | Control | Test | Control | Test | Control | Test | Control | Test |
| 1 | 0.11 | 0.1 | 0.3 | 0.23 | 0.33 | 0.15 | 0.32 | 0.36 | 0.57 | 0.44 |
| 2 | 0.13 | 0.11 | 0.43 | 0.32 | 0.38 | 0.27 | 0.55 | 0.64 | 0.83 | 0.81 |
| 3 | 0.14 | 0.12 | 0.42 | 0.32 | 0.47 | 0.36 | 0.77 | 0.69 | 0.91 | 0.94 |
| 4 | 0.15 | 0.16 | 0.42 | 0.37 | 0.41 | 0.4 | 0.86 | 0.71 | 1.05 | 0.99 |

TABLE 3-continued

| Puff Number | TPM per puff (mg/puff) Sample 1 Control | Sample 1 Test | Sample 2 Control | Sample 2 Test | Sample 3 Control | Sample 3 Test | Sample 5 Control | Sample 5 Test | Sample 7 Control | Sample 7 Test |
|---|---|---|---|---|---|---|---|---|---|---|
| 5 | 0.25 | 0.14 | 0.52 | 0.26 | 0.56 | 0.37 | 1.0 | 0.8 | 1.13 | 0.99 |
| 6 | 0.24 | 0.05 | 0.6 | 0.25 | 0.66 | 0.29 | 1.11 | 0.66 | 1.31 | 1.02 |
| 7 | 0.4 | 0.12 | 0.66 | 0.23 | 0.76 | 0.29 | 1.3 | 0.54 | 1.44 | 0.94 |
| 8 | 0.41 | 0.17 | 0.71 | 0.28 | 0.93 | 0.31 | 1.46 | 0.75 | 1.67 | 1.12 |
| 9 | / | 0.22 | / | 0.3 | / | 0.41 | / | 0.89 | / | / |
| Total TPM (mg/cig) | 1.83 | 1.19 | 4.06 | 2.56 | 4.5 | 2.85 | 7.37 | 6.04 | 8.91 | 7.25 |

machine smoked as described in Example 2 and the results for TPM on a puff-by-puff basis are shown in Table 5 and graphically presented in FIG. 15.

TABLE 4

| Sample | Blend | Tobacco Density (mg/cc) | Cigarette Paper Permeability (CU) | Filter Pressure Drop (mm/WG) | Tip Ventilation (%) | ISO NFDPM (mg/cig) |
|---|---|---|---|---|---|---|
| 1 Control | Modified Flue-cured | 210 | 50 | 100 | 82 | 1.3 |
| 2 Test | Modified Flue-cured | 210 | 50 | 90 | 75 | 1.6 |

It is clear from the results of Table 5, and from FIG. 15, that the test cigarette produced higher TPM in the first few puffs, notable in puffs 1-4, but a significantly reduced amount of TPM in the last few puffs during smoking, and in particular puff numbers 7-9. This shows that cigarettes according to the invention result in a flatter puff profile when smoked and significantly reduce TPM in the final few puffs and raise TPM in the first few puffs.

The cigarettes in this Example were evaluated by a sensory panel using a paired comparison study, as is well-known in the industry. A statistical analysis of the results gave a significant difference between the control and sample cigarette for draw effort, mouthful of smoke, flavour amplitude and acceptability. The draw effort was lower for the test sample, whilst for each of the other attributes the test sample was considered to provide a higher result.

TABLE 5

| Puff Number | TPM per puff (mg/puff) Sample 1 Control | Sample 2 Test |
|---|---|---|
| 1 | 0.11 | 0.23 |
| 2 | 0.13 | 0.32 |
| 3 | 0.14 | 0.32 |
| 4 | 0.15 | 0.37 |
| 5 | 0.25 | 0.26 |
| 6 | 0.24 | 0.25 |
| 7 | 0.4 | 0.23 |
| 8 | 0.41 | 0.28 |
| 9 | / | 0.3 |
| Total TPM (mg/cig) | 1.83 | 2.56 |

EXAMPLE 4

Sample cigarettes (i.e. control cigarettes) were made having a standard king-size format, namely 83 mm length and 24.6 mm circumference, with a cellulose acetate filter element 27 mm in length, a 32 mm overtipping and having on-line laser tip ventilation.

Test cigarettes were constructed with the same characteristics as the sample cigarettes with the addition of an activated carbon patch on the inside of the wrapper at the filter end of the cigarette. Each activated carbon patch had a length of 34 mm and a width of 24 mm and had a composition as follows: base weight of 91 gsm (fibre 35 gsm, carbon 33.6 gsm, giving a carbon loading of approximately 37%, calcium carbonate 22.0 gsm,); porosity of 131 CU; potassium citrate loading of 0.5% (w/w); tensile strength of 39N/50 mm; elongation of 2%; thickness of 192 μm; carbon activity of 100 CTC.

The cigarettes were machine smoked under ISO accredited standard conditions (35 cc puff volume; 2 second puff duration; 58 second inter puff duration) and the total Nicotine-Free Dry Particulate Matter (NFDPM) results for the test cigarettes compared to the control cigarettes are set out in Table 6. The samples have differing tar yields and encompass a range of tar yields common in known cigarettes. Also shown in the final column of Table 6 is the reduction in NFDPM (mg/cig) for each of the test cigarettes in comparison to the respective control sample.

TABLE 6

| Sample | NFDPM (mg/cig) Control | Test | Reduction |
|---|---|---|---|
| 1 | 1.6 | 1.4 | 0.2 |
| 2 | 3.5 | 2.4 | 1.1 |
| 3 | 7.2 | 5.2 | 2.0 |

It can be seen from Table 6 that each of the test samples resulted in a reduction in total NFDPM similar to that shown in Table 2 in Example 1.

The invention claimed is:

1. A smoking article comprising a rod of smokable material, a wrapper circumscribing said rod of smokable material and a patch of web material, said patch of web material comprising an adsorbent material and being positioned towards a mouth end of the smoking article and extending over only a portion of the length of the rod of smokable material, wherein said patch of web material does not comprise a flavourant therein, and wherein a portion of said rod of smokable material over which said patch of web material extends comprises a lower weight per unit length of smokable material.

2. A smoking article according to claim 1, wherein density of smokable material is constant along the length of the rod of smokable material.

3. A smoking article according to claim 1, wherein said patch of web material is positioned between said rod of smokable material and said wrapper.

4. A smoking article according to claim 1, wherein said web material is adhered to an inner surface of said wrapper.

5. A smoking article according to claim 1, wherein said web material is paper.

6. A smoking article according to claim 1, wherein said adsorbent material is activated carbon.

7. A smoking article according to claim 1, wherein said patch of web material is of a substantially rectangular, square, triangular, rhomboid or oval shape.

8. A smoking article according to claim 1, wherein the adsorbent material is present in an amount of less than 70% by weight of the web material.

9. A smoking article according to claim 8, wherein the adsorbent material is present in an amount of less than 50% by weight of the web material.

10. A smoking article according to claim 9 wherein the adsorbent material is present in an amount of 10-45% by weight of the web material.

11. A smoking article according to claim 10, wherein the adsorbent material is present in an amount of 30-45% by weight of the web material.

12. A smoking article according to claim 1, wherein said patch of web material comprises inorganic filler.

13. A smoking article according to claim 12 wherein said inorganic filler is calcium carbonate.

14. A smoking article according to claim 12, wherein the inorganic filler is present in an amount of less than 70% by weight of the web material.

15. A smoking article according to claim 14, wherein the inorganic filler is present in an amount of less than 50% by weight of the web material.

16. A smoking article according to claim 15, wherein the inorganic filler is present in an amount of 10-30% by weight of the web material.

17. A smoking article according to claim 1, wherein said patch of web material comprises an additive to control burn rate.

18. A smoking article according to claim 17, wherein said additive is a citrate.

19. A smoking article according to claim 17, wherein the burn rate additive is present in an amount of up to 5% by weight of the web material.

20. A smoking article according to claim 19, wherein the burn rate additive is present in an amount of up to 2% by weight of the web material.

21. A smoking article according to claim 20, wherein the burn rate additive is present in an amount of up to 0.1-2% by weight of the web material.

22. A smoking article according to claim 1, wherein said web material has a porosity greater than 50 CU.

23. A smoking article according to claim 1, comprising two patches of web material.

24. A smoking article according to claim 23, wherein said two patches of web material extend to differing amounts over the length of said rod of smokable material.

25. A smoking article according to claim 1, and further comprising a filter element.

26. A smoking article according to claim 25, wherein said filter element is ventilated.

27. A smoking article according to claim 26, wherein said filter element is ventilated to a level greater than 50%.

* * * * *